United States Patent [19]

Trame

[11] 4,258,490

[45] Mar. 31, 1981

[54] PRICE DISPLAY BOARD WITH TAPE PRESSING AND LOCKING MEANS

[75] Inventor: Charles E. Trame, Mequon, Mich.

[73] Assignee: Everbrite Electric Company, South Milwaukee, Wis.

[21] Appl. No.: 51,469

[22] Filed: Jun. 25, 1979

[51] Int. Cl.[3] ..... G09F 3/18

[52] U.S. Cl. ..... 40/518; 40/10 R; 40/16; 40/489

[58] Field of Search ..... 40/10 R, 16 R, 16.2, 40/16.4, 16.6, 447, 452, 489, 490, 491, 518, 576, 609

[56] References Cited

U.S. PATENT DOCUMENTS

| | | | |
|---|---|---|---|
| 2,172,528 | 9/1939 | Auer | 40/10 R |
| 2,928,198 | 3/1960 | Mandanick | 40/576 |
| 3,939,584 | 2/1975 | Trame | 40/576 X |
| 4,090,315 | 5/1978 | Brown, Jr. et al. | 40/518 |
| 4,095,359 | 6/1978 | Trame | 40/518 X |
| 4,174,580 | 11/1979 | Sanders et al. | 40/518 |
| 4,177,588 | 12/1979 | Gebhardt et al. | 40/518 X |

*Primary Examiner*—John F. Pitrelli
*Assistant Examiner*—G. Lee Skillington
*Attorney, Agent, or Firm*—Ralph G. Hohenfeldt

[57] ABSTRACT

In a price display board self-coiling plastic tapes having a sequence of numerals imprinted on them are translatable past rows of windows. Tape holders behind the windows have platens for supporting the tapes from their rear faces. The platens have one edge molded integrally with the holders and three free edges so they can act as preflexed flat springs for pressing the tapes against tape guide flanges which extend along the sides of the windows.

3 Claims, 3 Drawing Figures

PRICE DISPLAY BOARD WITH TAPE PRESSING AND LOCKING MEANS

BACKGROUND OF THE INVENTION

This invention relates to signs or displays for displaying prices of items in stores and restaurants, for example. In particular, the invention is an improvement in the kind of display device that has characters or numerals for composing a price imprinted on adjacent precoiled and self-recoiling plastic tapes where the tapes pass windows to display the numerals and to allow access with a finger so the tapes can be translated to positions where all of the numerals in a row compose the price.

A display device using precoiled tapes is illustrated in U.S. Pat. No. 3,939,584, dated Feb. 24, 1976, which is assigned to the assignee of this application. The improvement of the present invention over the patented device is to provide a simple means for performing the dual functions of pressing any wrinkles or bulges out of the tapes in the window areas and also to lock the tapes more positively in the window areas and thereby prevent inadvertent translation or slipping.

In the display device referred to above, the plastic tapes on which the numerals are imprinted have internal stress which causes the free ends of the tapes to become self-coiling or self-winding when the tape ends are unrestrained. The tapes are installed in a holder having adjacent windows for exposing the sequences of numerals which are printed on them and which are used to compose a price. There are flanges or tracks at the side edges of each window for guiding the tapes past the windows. The holders have platens for backup walls, respectively, extending across the windows behind the tapes. The platens, which are molded integrally with the holders, are curved and intended to take up slack and restrain the tape against wrinkling or bulging. Another purpose of the platens is to permit a user to apply fingertip pressure on the tapes followed by a frictional translating force in order to index the sequence of numerals past the window.

Because of the prestressed numeral bearing tapes having a tendency to coil at both ends, the tapes were not always pulled tightly against the platens. This adversely affected the appearance of the row of numerals composing the price. A tape bulging problem also occurred on some occasions. This was because the tapes were bent sharply rearwardly toward the place where the coils are formed. If no change was made in the tape position for an extended period of time, the bends would take on a tentatively permanent set, especially if the tapes were exposed to heat such as from the sun. Then, when a tape was translated by the amount of one numeral to set up a new price, a bulge or wrinkle would often occur in the window where the tape had taken on the permanent set.

SUMMARY OF THE INVENTION

Objects of the present invention are to provide means for developing a controlled pressing force on the tapes in the window area for the dual purposes of suppressing bulges and also imposing a controlled frictional force on the tapes for holding them firmly in the positions to which their numerals have been indexed.

In accordance with the invention, the improved display comprises a frame in which tape holders are mounted. The holders have windows. Short flanges or tracks extend toward each other laterally from opposite side edges of the window. Platens are molded integrally with the holders and extend substantially across the height and width of the respective windows behind the tape. Three edges of a platen are free and another edge, which joins with the holder, serves as a cantilever hinge so the platen acts like a flat spring. The platens are molded at an initial angle which causes them to have a natural tendency to spring into the windows, but they are yieldable so the tapes can be easily threaded between the faces of the platens and their respective guide tracks. When finger pressure that has been applied for translating a tape is relieved, the platen tends to spring forward and press the tape against the guide track flanges to thereby smooth it and secure it.

Achievement of the foregoing and other more specific objects and examples of how the invention may be implemented will now be set forth in reference to the drawing.

DESCRIPTION OF A PREFERRED EMBODIMENT

Figure 1:
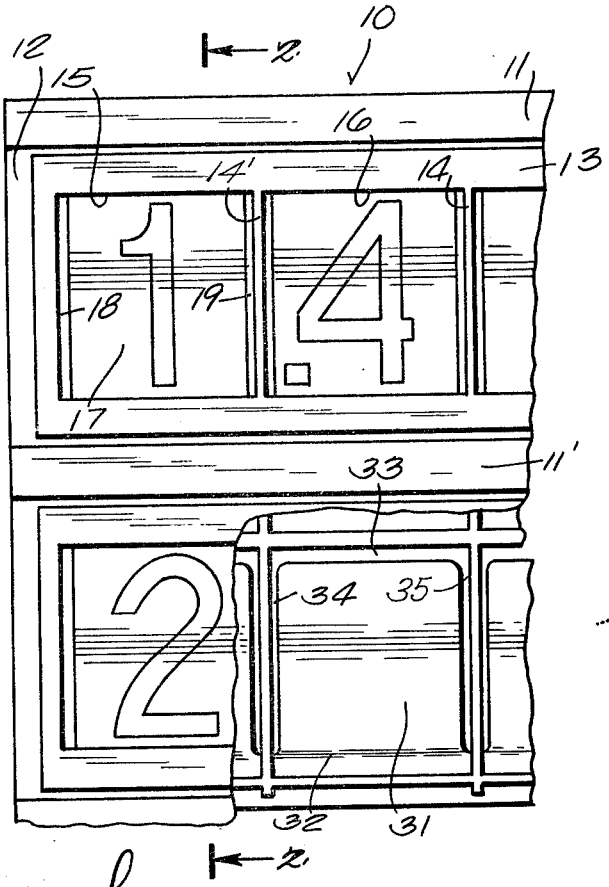
FIG. 1 is an elevation view of a fragment of a price display board in which the new springy tape smoothing and restraining platen is used.

The price display board in FIG. 1 comprises a support frame 10 having unitary flat cross members 11 and 11' and side members such as the one marked 12. A flanged rectangular window frame 13 is set in a suitable opening in the support frame 10. A plurality of ribs such as 14' and 14 divide the window frame 13 into open front windows such as 15 and 16. A typical precoiled tape 17 having the sequence of numbers 0-9imprinted on it is mounted on a holder for running past the illustrated windows 15 and 16 to display any of the numerals on the tapes such as the numerals 1 and 4 which are shown in FIG. 1. In the case of window 15, which is typical, laterally inwardly extending tracks or flanges 18 and 19 provide guidance when the tapes are translated longitudinally.

Figure 2:
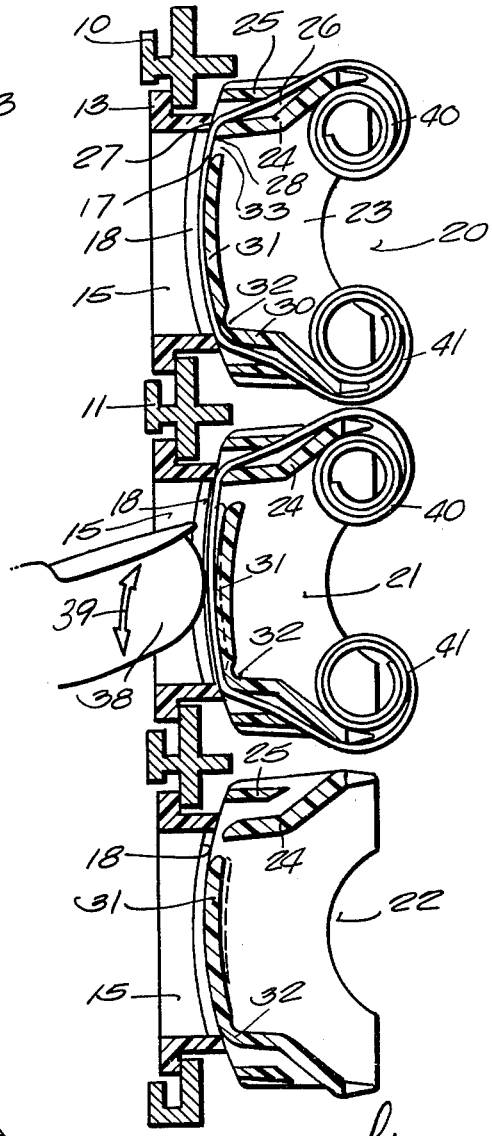
FIG. 2 is a vertical section taken on a line corresponding with 2—2 in FIG. 1.

FIG. 2 shows the molded plastic holders 20, 21 and 22 which hold the rows of tapes such as tape 17 behind the window openings such as opening 15. Holder 20, like the others, has sidewalls, one of which is marked 23. Extending integrally from wall 23 and laterally of window opening 15 are a pair of guides 24 and 25 which define a rearwardly extending passageway 26 through which the tape 17 is threaded. The back edge 27 of the window margin and an edge of guide member 24 define a slot 28 for further guiding the tape along the curved path established by guide flanges or tracks 18. Note that in the interest of making the tape holders compact, tape 17 is caused to make a rather sharp bend in slot 28 and there are other sharp bends which can cause more or less tentative permanent sets or bends in the tape which could bulge if they happen to stop in a window.

Also extending transversely of the window between holder end walls such as the one marked 23, is another guide member 30 which, for the most part, is similar to guide member 24. A platen or backup member 31 is molded integrally with guide member 30. In the region marked 32, where platen 31 joins guide member 30, the cross section of these elements is reduced in thickness so that platen 31 can act as a flat cantilever spring for pressing the tape against flanges 18. Note in FIG. 2 that platen 31 does not extend over the full height of window 15 but there is a gap 33 above the upper tip of the platen which allows the platen to flex like a spring. The lower portion of FIG. 1 shows that platen 31 also has side gaps 34 and 35 which leave the platen free to pivot as a flat or cantilever spring about fixed edge 32.

Now refer to the lowermost holder 22 in FIG. 2 into which a precoiled tape has not been threaded as yet. Here one may see that, in the absence of the tape, platen 31 tends to spring counterclockwise into window opening 15 but the width of the platen 31 is such that it swings clear of and between laterally extending flanges or tracks 18. Hence, to install a precoiled numeral bearing tape in the holder 22, one of the tape ends is uncoiled and inserted through guide slots 26 and 27 at which time it is necessary for the user to apply a force on the platen 31 to bend it back to its dotted line position as in the lowermost holder of FIG. 2. The tape can then be advanced along the back of guide flange 18 and pulled out at the lower end and stretched back to a point where it will coil automatically.

Translating a tape to change the numeral which is visible through a window is demonstrated in the holder which is generally designated by the reference numeral 21. The procedure involves having the user press his fingertip 38 against the front surface of tape 17 to cause the springy platen 31 to deflect rearwardly. The user then applies a frictional force on the tape in one direction or another as indicated by the doubleheaded arrow 39 to cause the tape to translate in the desired direction. Upon this event, one of the coils such as 40 at the end of the tape will take up tape and the other coil 41 will pay out tape, or vice versa. When the user has established the desired numeral in window 15, his finger is withdrawn in which case spring platen 31 deflects forwardly to press its edges against the guide flanges 18 and put a stress on the tape which removes any wrinkles or bulges which might be present. Moreover, the friction between the edges of the tape and the guide tracks at the edges is augmented so that the tape is effectively fixed against inadvertent translational movement.

Figure 3:
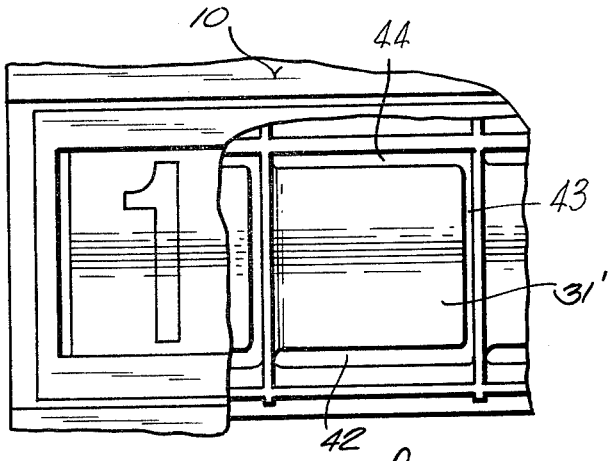
FIG. 3 is a front elevation of a fragment of a price display board which uses an alternative form of tape smoothing and restraining platen.

It should be appreciated that cantilever spring or platen 31 can be hinged on one of its side edges instead of its bottom edge 32 as in the FIG. 2 embodiment. For example, an alternative is shown in FIG. 3 where the platen, marked 31', is fastened on one of its side edges adjacent one track so as to leave free spaces or gaps 42, 43 and 44 around the other three edges of platen 31'. Thus, platen 31' in FIG. 3 is adapted to flex forwardly and in a plane which is orthogonal to the plane in which platen 31 flexes in the FIGS. 1 and 2 embodiment.

It should be evident from the description given above that during the molding process platen 31 will be formed so it has an inherent tendency to deflect toward its solid line position as exhibited in the holder marked 21. Then, whenever a force is applied perpendicular to the front surface of the platen it will bend and become loaded as a cantilever or flat spring and will assure its dashed line position as illustrated in holder 21 to enable a tape to be threaded in or translated for positioning a selected numeral in the window.

The holders including platen 31 may be molded from a clear or translucent plastic as desired. In some cases clear plastic is used to provide for transmitting light through the platen for illuminating the numerals on the tape from the rear while in other cases, where ambient light is depended on for illuminating the numerals, the platen may be molded from opaque plastic.

Although illustrative embodiments of the invention have been described in detail, the true scope of the invention is to be determined only by interpreting the claims which follow.

I claim:

1. A device for displaying characters to compose descriptions such as prices including self-coiling plastic tapes on which the characters are imprinted in sequences extending longitudinally of the respective tapes, said device comprising:

means providing a pair of longitudinally spaced apart edges and a pair of laterally spaced apart edges cooperating to define a window past which a tape may be translated to expose its characters for visualization from the front surface of the tape, a flange extending along each of the edges of at least one pair of window edges for the front surface of said tape to react against, a tape support composed of plastic located behind the window and a platen element located behind said window, said platen element being joined integrally with said support and extending in cantilever fashion across a major portion of the window and having an inherent tendency to flex toward the front of said window to thereby press said tape against said flanges.

2. The device as in claim 1 wherein said platen element is joined to said tape support adjacent one of said laterally spaced apart window edges.

3. The device as in claim 1 wherein said platen element is joined to said tape support adjacent one of said longitudinally spaced apart window edges.

* * * * *